US012110162B2

(12) United States Patent
Herrera Muñoz

(10) Patent No.: US 12,110,162 B2
(45) Date of Patent: Oct. 8, 2024

(54) CARRIER DEVICE FOR GROUPING AND TRANSPORTING A SET OF BEVERAGE CANS

(71) Applicant: Jorge Fundador Herrera Muñoz, Maipú Santiago (CL)

(72) Inventor: Jorge Fundador Herrera Muñoz, Maipú Santiago (CL)

(73) Assignee: Jorge Fundador Herrera Muñoz, Maipú Santiago (CL)

( * ) Notice: Subject to any disclaimer, the term of this patent is extended or adjusted under 35 U.S.C. 154(b) by 152 days.

(21) Appl. No.: 17/910,659

(22) PCT Filed: Mar. 13, 2020

(86) PCT No.: PCT/CL2020/050018
§ 371 (c)(1),
(2) Date: Sep. 9, 2022

(87) PCT Pub. No.: WO2021/179099
PCT Pub. Date: Sep. 16, 2021

(65) Prior Publication Data

US 2023/0134359 A1 May 4, 2023

(51) Int. Cl.
*B65D 71/44* (2006.01)
*B65D 71/50* (2006.01)

(52) U.S. Cl.
CPC ..... *B65D 71/50* (2013.01)

(58) Field of Classification Search
CPC .... B65D 71/506; B65D 71/50; B65D 71/508; B65D 71/44; B65D 71/42
USPC ..... 206/427, 158, 148, 150, 151, 156, 149, 206/145, 147
See application file for complete search history.

(56) References Cited

U.S. PATENT DOCUMENTS 3,721,337 A * 3/1973 Braun ..... B65D 71/506 294/87.2
3,733,100 A * 5/1973 Tanzer ..... B65D 71/504 294/87.2
4,033,457 A * 7/1977 Weaver ..... B65D 85/67 206/390

(Continued)

OTHER PUBLICATIONS

International Search Report for related International Application No. PCT/CL2020/050018; report dated Sep. 16, 2021; (3 pages).

(Continued)

*Primary Examiner* — Steven A. Reynolds
(74) *Attorney, Agent, or Firm* — K&L Gates LLP

(57) ABSTRACT

A Carrier device for grouping and transporting a set of cans of beverages into a package; the carrier comprises an upper central area arranged on a level above the top plane of the cans; clamping flanges surround and fit snugly to the tapered trunk portion of the can, and have a mantle with proximal, rising ends; a series of radial cuts forming two types of retainer flaps, where each retainer flap comprises a perimeter contour generated by a polygonal-elliptical cut line which in turn generates a cover flap that remains attached and co-planar to the central area of the device; and transition portions which extend in a downward sloping manner as a continuation of the upper central area and join laterally with the proximal ends of the flanges.

18 Claims, 9 Drawing Sheets

(56) References Cited

U.S. PATENT DOCUMENTS

| | | | | | |
|---|---|---|---|---|---|
| 4,546,876 | A * | 10/1985 | Rhoads | B65D 71/504 294/87.2 |
| 5,503,267 | A * | 4/1996 | Sutherland | B65D 71/48 206/148 |
| 5,944,174 | A * | 8/1999 | Marco | B65D 71/504 206/148 |
| 11,623,804 | B2 * | 4/2023 | Slovik | B65D 71/504 206/145 |
| 2004/0206639 | A1 | 10/2004 | Karlsson | |
| 2010/0264043 | A1 | 10/2010 | De Paula | |
| 2017/0190488 | A1 * | 7/2017 | Bates | B32B 3/266 |
| 2018/0222650 | A1 | 9/2018 | Zacherle | |
| 2023/0159246 | A1 * | 5/2023 | Chesnet | B65D 71/506 206/147 |

OTHER PUBLICATIONS

Written Opinion for related International Application No. PCT/CL2020/050018; report dated Sep. 16, 2021; (13 pages).

* cited by examiner

CARRIER DEVICE FOR GROUPING AND TRANSPORTING A SET OF BEVERAGE CANS

CROSS-REFERENCE TO RELATED APPLICATION

The present application is a National Stage of International Application No. PCT/CL2020/050018 filed on Mar. 13, 2020, the disclosure of which is incorporated herein by reference in its entirety.

FIELD

This application is applicable in the technical field of packaging. More specifically, the present disclosure refers to a cardboard device for grouping and transporting a set of beverage cans forming a package that allows a consumer to lift and handle a plurality of them.

BACKGROUND

Cylindrical cans are used in the beverage industry to contain beverages, soft drinks, beer or similar, and to transport a plurality of cans. Package sets are provided, which can comprise from two cans to 24 in cases of mass transport. But for consumer-level handling at a point of sale different types of means have been provided so far to group the cans into packages normally of 4 or 6 containers, to enable a consumer to lift and handle them together.

In the prior art it is possible to see that many of the means developed are manufactured from plastic materials, which are used as means of assembling packages, for example, in the form of a plastic film wrap extending around the packed cans.

There are also solutions of the type formed by a series of plastic rings connected in rows, usually two in parallel, which are applied in such a way around the cans that they grip around the part which has a reduced cylindrical diameter below the top ring the cans normally have; an example of this can be seen described in U.S. Pat. No. 5,305,877A of Illinois Tools Works.

The problem is that such plastic devices can end up as garbage scattered in places where animals are found, for example, birds, fish and water rodents. Many of them can get caught in these rings, and unfortunately, once caught they can be damaged to death. Similarly, fish and aquatic animals can become trapped in the rings and often cannot be released, and the result of being trapped in a holding ring is often death.

The manufacturers of the various plastic devices for packaging beverage assemblies of bottles or beverage cans have not properly considered the fact that it is known that humans discard disposable items in inappropriate areas.

Initiatives have been found in the prior art allowing such plastic devices to cause less damage than described above, such as the can holder described in Thomas Rathbone's U.S. Pat. No. 5,193,673A, where the plastic ring assembly incorporates pre-cut lines which forcefully break the ring when the can is removed, so that the ring is left open, ensuring that said devices are not trapped in the animals. Although this is an improvement, this device is also plastic and once discarded, it can still reach the environment as garbage and take years to degrade.

Other types of can holders have been introduced made from a combination of cardboard and plastic in separate pieces, using a cardboard bottom and a stretch or shrinkwrap. This solution is mainly used for large units comprising 24 cans, and although it incorporates pieces of cardboard, plastic remains an environmental risk because ensuring that it does not end up as waste affecting nature is not possible.

There are also cardboard can packaging devices that completely wrap the containers, such as the solution described in Canadian patent CA2124823 of Riverwood International Corp. This solution is unsatisfactory as the cost is such that it is not suitable for use in transporting smaller groups of six cans or four cans. However, compared to plastic, cardboard material has great advantages for the environment, as it decomposes in nature, adding to its potential recyclability.

An improvement of the above-mentioned product is a type of can holder for packed cans with a cardboard device which wraps only a smaller upper portion of the cans, such as the device described in the British patent GB1604840 of Michael Fred Joyce, where vertically folded down flaps are provided which, through a straight perforated slot, hold the bottom of the can lid, i.e. it rests against the edge of the lid on diametrically opposite sides of the can. The problem with this type of device is that they have several folded portions that take a lot of time and steps to assemble, and are not functionally satisfactory, since the way the user must lift or take the assembly does not ensure the unfolding of the parts, the structure will be lost and the cans will come loose.

Another frequent problem with devices for forming can assemblies from small pieces of cardboard has to do with the appropriate or sufficient surface area to provide advertising information to identify the product on both its sides and top sides. Some solutions developed have an additional top cover, but have the problem that they eventually use a lot of material to provide an advertising support face, as described in U.S. Pat. No. 5,503,267 by Riverwood International Corp.

Some devices seeking to solve the advertising support problem have incorporated additional pieces partially covering the sides of the can assembly or central plates that act as handles and as graphic support, such as several of the embodiments described in the North American application US2018362234A1 of Fishbone Packaging.

However, the device mentioned above, like other solutions made of cardboard which are very simple formed from a single sheet, such as those described in documents ES1208411 from Alzamora Carton or EP0595602A1 from Mead Corp. have the problem that although they occupy a single sheet, they lack the means to cover the upper face of the cans to protect them from the dirt which normally accumulates on their lids, they lack a surface suitable for advertising and most importantly, they are flat plates protruding towards the sides of the walls of the cans, defining a wider margin that prevents tight storage of the packs of cans next to each other, where normally this proximity ends up causing the protruding edges to be flattened or folded between the same packs.

On the other hand, solutions have been developed that seek to provide a protective cover for the upper face of the cans while serving as a support for graphic information, such as the devices shown in the European patent EP1401728 by Smurfit Kappa Packaging or in the Spanish patent ES2159235 by Enric García, which in the case of the former has upper bands that cover the cans, where the bands are in the form of successive circles linked by rectangular portions, where the bands are arranged in a plane raised above the base of the device, so that a continuous surface is not generated which is at least central and occupies a significant percentage of the upper face allowing advertising information to be placed and to be perceived in a consistent manner.

The same is true for the second document cited, which comprises a plurality of biconvex figures which remain on the upper face of the cans, all of them in a plane elevated in relation to the base plane of the device, so that it does not allow advertising to be placed that can be perceived coherently as it would be on a continuous surface; furthermore, in the latter case, the covering flaps are joined to the base by means of an unfolding mechanism made up of several opposing cuts, which is complex to produce.

One of the existing devices in the prior art which optimizes the use of material and proposes a fairly simple piece which avoids edges or margins protruding from the sides, is that described in WestRock Packaging application US20180222650A1, where a sheet with circular openings comprising flanges on its entire perimeter can be seen and where all the flanges comprise a folding line in its base area allowing those flanges to unfold with respect to their base sheet in order to fit under the entire perimeter of the top ring of the cans. Although this solution is simple and uses very little material, the truth is that these smaller dimensions are only functional if the material presents a greater resistance to the cardboard normally used, which is verified in the description of this disclosure, since to achieve resistance with smaller sections a material developed by the same applicant called Natralock is used, which consists of a cardboard made or coated with materials which increase resistance, based on one or more polymeric layers joined to at least one layer of cardboard.

As can be seen, the manufacturing material is a composite material with plastic layers which again represents damage to the environment, as these materials cannot be recycled and their degradation time substantially increases considerably compared to a material made only of cardboard.

There is therefore a need for a carrier device to transport beverage cans assembled in a package as a single unit, which if disposed of inappropriately will not have a harmful effect on the environment. A major technical challenge is to achieve a simple device, which uses little material, is cheap to produce, simple to assemble and able to withstand the stresses of breakage despite occupying only biodegradable material, such as cardboard.

DISCLOSURE SUMMARY

The present disclosure refers in general to a carrier device for transporting a plurality of beverage cans assembled in a package as a single unit, where one of its main objectives is to be environmentally safe.

Another main objective of the disclosure is to provide a carrier device which allows a strong attachment with the use of little material, devoid of side walls covering the body of the cans or of portions of material protruding laterally from the perimeter formed by the group of cans, so as to facilitate the storage and display of the packages at the points of sale without the risk of damage to each other by colliding or rubbing against each other.

Another objective of the present disclosure is to provide a can-carrying device which, although formed with little material, provides an upper surface which protects the upper face of the cans by preventing them from accumulating dirt.

Still another objective of the present disclosure is to provide a can-carrying device which provides a continuous central area available for advertising printing.

An additional objective of this disclosure is to provide a can-carrying device which provides simple means for being lifted and manipulated by the user.

Still another additional objective of this disclosure is to provide a template for forming the can-carrying device which facilitates its manipulation for mounting on the assembled cans and which ideally provides little loss of material.

Thus, the present disclosure provides a carrier device for grouping and conveying an assembly of cans of beverages forming a package, where the cans are of the type formed by a cylindrical body with a conical upper trunk portion having a raised upper ring under which a neck of smaller diameter than said upper ring is defined.

The carrying device is made of a single piece in the form of a laminated plate made of semi-rigid material, such as a sheet weighing between 250 and 600 grams per square millimeter. More importantly, this material should be 100% degradable and recyclable cellulosic, so that it can be disposed of quickly and is not a danger to wildlife.

The device essentially comprises the following: an upper central area that is substantially horizontal and arranged at one level above the upper face of the cans; clamping flanges surround and adapt to the truncated conical shape of the cans, being made of mantle with ascending proximal ends that end in a point with the lower side inclined; can receiving openings which have a series of radial cuts forming two types of retainer flaps, where each receiving opening comprises a perimeter contour generated by a polygonal-elliptical cut line which in turn generates a cover flap that is attached to and coplanar with the central area of the device; and radial transition portions that extend in a downwardly inclined manner as a continuation of the upper central area and connect laterally with the inclined proximal ends of the flanges.

The device has a quadrilateral shape contour, which may be of rectangular, rhomboidal or similar shapes, preferably square, provided with can receiving openings whose contour has a series of radial cuts forming retaining fins fitting below the raised can ring when the device is mounted on the plurality of cans to form a package.

The device comprises a contour preferably formed by four parallel sides in pairs, with rounded or beveled corners or a combination thereof. The laminar plate exhibits an upper face, a lower face and the contour formed by four parallel sides in pairs, so that the laminar plate can be virtually divided into quadrants or more portions based on a longitudinal central axis, a transverse central axis and diagonal axes at 45° intersecting at a central point of the laminar plate.

Where these four sides of the laminar body are provided with at least one recess between the flanges, this recess may be triangular, trapezoidal, concave or a combination of these, preferably a triangular shape with a rounded bottom.

The can receiving openings can be an even number, preferably two, four, six or more, preferably four. They have a polygonal-elliptical contour with a larger diameter arranged along the opening and at least a smaller diameter arranged along the width of the opening, where these openings are oriented diagonally in the device, their largest diameter coincides with a diagonal axis at 45° to the longitudinal and transverse center axes, and where the openings are arranged equidistant and symmetrical to the longitudinal and transverse center axis.

As mentioned above, the contour of the receiving openings is polygonal-elliptical and has a series of radial cuts that form retainer fins fitting below the can's raised ring and extending to the top of the flange mantle integrally with them, i.e. the retainer fins have no folds or lines across the radial cuts that would intentionally cause the fins to tilt in a different plane than the flange mantle.

These radial cuts are distributed on the contour, especially in a central area and a distal area of the contour, except for a proximal area of the opening which is adjacent to the centre of the laminar body, so that the cans are not retained in the openings in this proximal area, because it lacks retainer fins.

The device comprises a substantially horizontal continuous central area arranged at one level above the upper plane of the cans, from which the clamping flanges which adapt to and surround the conical trunk shape of the cans extend radially, its mantle comprising ascending proximal ends, where these flanges are joined to the upper central area of the device through the radial transition portions.

The flanges fit tightly to the upper conical trunk portion of the cans, while the contour of the elliptical opening fits under the raised ring of that can over the entire perimeter, except in the area where the flaps arise.

The carrier device has transition portions extending continuously downwards from that horizontal central area of the device to join laterally in a progressive manner with the proximal ends of the flanges, where the transition portions comprise the transition portions having concave curved side edges, a rounded upper end area which merges with the upper central area and a concave curved edge opposite lower end which coincides with the incoming recesses on each side of the carrier device; while its upper area coincides with the birth of the clamping flanges.

Each of these receiving openings is generated by a polygonal-elliptical cut line which is interrupted in a portion adjacent to the central area of the sheet, generating a covering flap of also polygonal-elliptical shape which remains attached to the sheet through said interrupted portion of the cut line, allowing the flaps to rest on the upper faces of the cans and acquiring a coplanar position with said upper central area of the device.

The covering flaps protect the top of the cans from soiling, while being coplanar with the upper central area of the laminate body they form together with it a larger continuous top portion available as a support for printing graphic or advertising information, so that the device allows both protection against soiling and the arrangement of a significant continuous area for advertising without having to add another top sheet or portions of sheet surrounding the sides of the cans.

In this central upper area of the laminate body there is a central hole suitable to serve as a handle where the user inserts a finger and lifts the package of cans gathered by the device. This hole is formed by an incomplete circular cut with one or more bridges joining the trimmed portion to the edge of the hole, so that initially the hole remains covered as part of the continuous upper surface where advertising is arranged, and only at the time when the user picks up the can package, said trimmed portion comes off and sinks into the device.

The receiving openings comprise a series of radial cuts forming two types of retainer fins which allow the portion of the receiving opening flanked by the flange to be recessed below the can's raised ring, while the portion diagonally opposite the radial cuts remains level with the upper horizontal centre area of the device.

The two types of retainer fins consist of a plurality of pairs of radial cuts, symmetrical and spaced apart each other, each consisting of a straight distal portion with one end coinciding with the polygonal-elliptical contour of the opening, and a curved-end proximal portion, where the curved ends of both radial cuts are opposite each other.

The two radial cuts of each pair are spaced apart each other by a distance that is less than the separation distance between each of the pairs of cuts, while the distance between the two cuts of each pair form an auxiliary holding flange corresponding to one of the types of holding fins; in turn, the separation distance between the auxiliary flanges form trapezoidal holding fins corresponding to the second type of fins mentioned above.

The auxiliary flanges have a joining point with the flange given by the separation between the opposite curved ends; however in all its radial extension they remain cut, generating a kind of notch between the trapezoidal fins, where these notches allow the inner edge of the opening to better adapt to the conical trunk portion of the cans when the flange acquires the same conical trunk shape, this being why these notches compensate the variations of the perimeter of the openings.

The radial height of the radial cuts is preferably equivalent to half the width of the flange, so that the flange is able to adapt in its transformation allowing controlled deformations in the form of folds that occur at the top of the mantle.

The distance between each of the receiving openings allows the beverage cans to be arranged tightly together, without a gap that can generate clearance and damage the parts of the device causing the cans to come loose and fall over.

The polygonal-elliptical shape of the openings generates a plurality of straight sections that become the distal edge of the trapezoidal fins and the auxiliary flanges, being this distal edge the one that fits under the raised ring of the cans. This straight shape of the edges ensures that the contact zone between the edge and the can ring is produced in the central area of these edges, increasing the resistance to compression of each fin, because if the cutting line that generates the openings were strictly curved, the distal edge of the fins and flanges would tend to be concave, this causing the contact zone with the ring to occur at their ends, which, being pointed, would have less resistance and could be deformed by compression.

On the other hand, the elliptical shape of the covering flaps compensates for the displacement they suffer when mounted over the ring of the cans, so that the larger diameter of the flaps is in turn larger than the diameter of the circular top of the cans, so that when the flap is moved towards the central area of the device, part of its contour remains over the top edge of the can and the rest remains inside the edge of the ring of the can, adapting to its circular shape without leaving significant gaps.

The fact that the auxiliary flange remains attached to the receiving opening after allowing the perimeter adjustment of the flange when it becomes conical in shape, allows the flange to cooperate in increasing the perimeter contact surface under the can ring, preventing it from occurring exclusively in the trapezoidal fins, increasing the resistance of the device.

Since the device is capable of providing a large continuous top surface to arrange advertising, which is formed by the central horizontal area that extends coplanarly towards the covering flaps, the handling of the device in an assembly line is facilitated, since that area which is a continuous large surface serves as a grip or suction area for the templates by an assembly machine.

This condition of the device of providing a continuous horizontal upper area and means of clamping for the cans that fits the perimeter of the cans in the conical trunk portion, is possible thanks to the conjunction of the characteristics described above, mainly given by the openings and covering flaps that have a non-circular contour, specifically an elliptical shape, in conjunction with the different retaining flaps arranged in its contour, plus the transition portions arranged between the flanges in conjunction with the upper central area and by the diagonal orientation of the openings in the laminar body, which allows these openings, being rather elliptical, to pass from an outer edge which is located below the can ring to an inner opposite edge which is located above the same ring to allow the flaps to be coplanar with the upper central area, without losing the grip of the cans.

This configuration allows that once the device has been installed in the group of cans and the user introduces his finger through the central hole, a radial tension is generated from the central point, which tensions the transition portions equally, and since the flanges are born in a progressive way they make the transition portions to pull the flanges in a combined scheme of forces going in an ascending inclination towards the center, making the different retaining fins fit even more under the can ring, especially in the first flanges near the birth of the flanges, where the greatest compression occurs, while in the rest of the flange there is more traction which increases a hugging effect around the conical trunk portion of the cans.

The disclosure also includes the template for forming the carrier device, which has a contour with four parallel perimeter sides in pairs, each with at least one recess centered in its middle area and beveled corners; a central area from which arched portions extend radially, the bases of which point towards the central area and each of which surrounds corresponding openings of polygonal-elliptical shape which are partially covered by a flap of polygonal-elliptical shape, where the contour of the openings comprises a series of radial cuts extending into the arched portions, which are grouped in pairs to form two different types of retainer fins; while intercalated between the arches there are radial transition areas of concave flanks extending from that central area to each of the middle zones of each of the four perimeter sides of the laminar plate.

The central area comprises at least an incomplete circular cut demarcating a circular hinged piece which goes inwards when the user inserts his finger and picks up the pack of cans; while these openings and flaps are generated by an elliptical, preferably polygonal, cut line which has an interrupted section located adjacent to the central area through which the covering flaps are attached to the laminar plate.

The cuts forming the retainer fins each consist of a straight distal portion with one end coinciding with the perimeter contour of the opening, and a proximal opposite curved-end portion, where the curved ends of both cuts of each pair of radial cuts are facing each other.

The two radial cuts of each pair of cuts are spaced from each other at a distance less than the separation distance between each pair of cuts and because the distance between the two cuts of each pair forms an auxiliary clamping flange.

The spacing between the auxiliary flanges form trapezoidal clamping flanges intercalated with the auxiliary flanges and where the radial height of the radial cuts is preferably equivalent to half the width of the arched portions.

The pairs of radial cuts are distributed over an outer portion of these arched portions which is approximately three-quarters of the length of the largest diameter of these polygonal-elliptical openings.

The contoured polygonal-elliptical openings and the arched portions surrounding them are at least two per template for carrying two cans; preferably, there are four per template, and alternatively it is also possible to form templates with a capacity of six cans.

These templates can be mounted manually on the cans, as well as they can be part of a semi-automated or fully automated assembly system. To this effect, it has some notches in some areas of its contour, where these notches allow the fixation of the template position in a machine that then rests on the aligned cans; preferably, these notches are arranged in the centered recesses that appear in the template contour and also in the beveled corners.

The templates can be part of an arrangement of several templates together to facilitate and optimize their installation; so, in the case of templates for four cans, these can be arranged in an arrangement of three aligned templates to carry twelve cans arranged in two rows of six cans each; alternatively, the arrangement of templates for four cans can be arranged in an arrangement of six aligned templates in two rows of three templates each, covering a set of 24 cans.

In the alternative embodiment of six-can templates, these can form template arrangements to be simultaneously installed in a group of six, twelve or twenty-four cans; thus, in the case of twelve cans, the templates are aligned lengthwise, joined by their adjacent smaller side, so that six cans each are installed on two rows. In the case of a group of twenty-four cans, the templates are four and are joined by their smaller sides and coinciding larger sides, which are placed on a group of cans arranged in four rows of six cans.

The set of templates arranged in arrays facilitates the handling of the assembly and its simultaneous installation on a larger number of cans, where the templates are joined together by weakened junction points, such that when the machine operates on the assembly of cans, each of the templates is separated from its adjacent one and the individual pack of two, four, six or more cans is assembled.

The pressure of the machine causes the deformation of the template, which is originally flat, on the upper faces of the cans, causing the arched portions to fold downwards into a conical trunk shape surrounding the conical portion of the cans, so that the reception openings, being elliptical, become inclined in a radial direction, and so that the edge of the opening, which coincides with the start of the flaps, is above the edge in the form of a raised ring of the cans, while as being inclined it fits underneath the ring of the can where it is retained by the set of flaps.

The template is made of a single laminated piece of 100% biodegradable and recyclable cellulose material, preferably a sheet weighing between 250 and 600 grams per square millimeter.

BRIEF DESCRIPTION OF THE DRAWINGS

For the accomplishment of the objectives, the disclosure can be made in the form illustrated in the attached drawings; however, the drawings are only illustrative and do not limit the scope of the disclosure, being able to acquire multiple embodiments, provided they are under a common inventive concept. Thus, a detailed description of the disclosure will be carried out in conjunction with the figures that are an integral part of this presentation, where.

DETAILED DESCRIPTION DISCLOSURE

Figure 1:
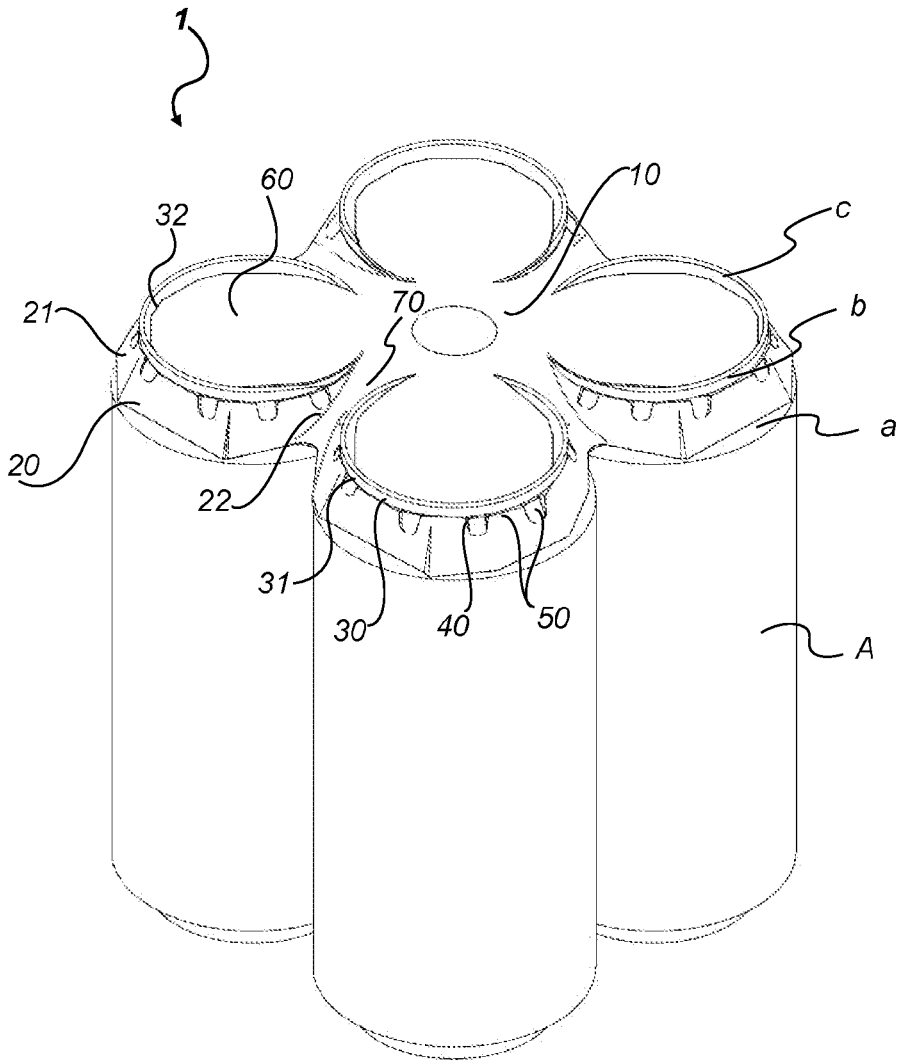
FIG. 1 shows an isometric top view of the carrier device mounted on a group of four beverage cans.

As seen in FIG. 1, the disclosure refers to a carrier device (1) for grouping and transporting an assembly of cans (A) of beverages forming a package, where the cans are of the type having a truncated cone top portion (a) with a raised top ring (b) that defines an upper plane (c) of the cans, the said device being manufactured from a single laminated body, having for each can an opening with flaps that fit under the raised ring (b) of the can (A) when the device is mounted on the plurality of cans (A) to form a package. The device provides a strong grip on cans with little material, allows cans to be grouped together without material protruding laterally from the edges of the cans, and provides a continuous top surface that protects the cans and increases the top area available for advertising printing It comprises a substantially horizontal upper central area (10) arranged at one level above the upper plane (c) of the cans (A); clamping flanges (20) surrounding and conforming to the conical trunk shape (a) of the cans; a mantle (21) with ascending proximal ends (22); can receiving openings (30) with a series of radial cuts (40) forming two types of retainer fins (50), where each receiving opening (30) comprises a perimeter contour (31) generated by a polygonal-elliptical cut line (32) which in turn generates a covering flap (60) which remains attached and co-planar to the central area (10) of the device (1); and transition portions (70) arranged between the flanges (20), which extend in a downwardly inclined manner as a continuation of the upper central area (10) and which join laterally with the proximal ends (22) of the flanges (20).

Figure 2:
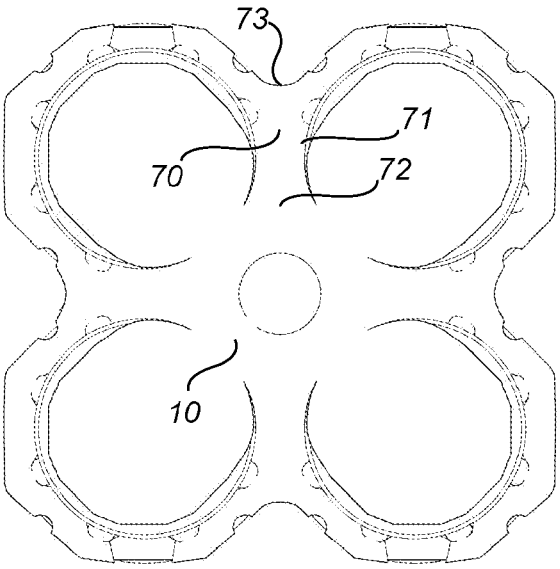
FIG. 2 shows an upper floor view of the carrier device mounted on a group of four beverage cans.

With reference to FIG. 2, the transition portions (70) have concave curved side edges (71), a rounded upper end area (72) that merges with the upper central area (10), and a concave curved edge opposite the lower end (73).

Figure 3:
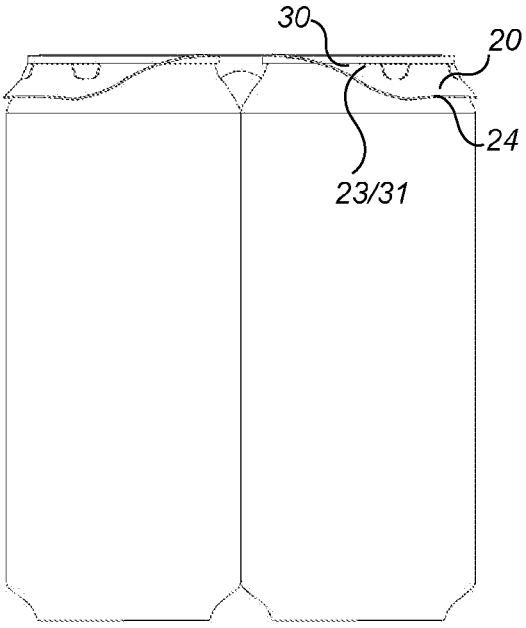
FIG. 3 shows a front cut view of the carrier device.

FIG. 3 shows that each of the clamping flanges (20) take the conical trunk shape of the upper portion (a) of the cans (A), have a smaller upper base (23) of a polygonal-elliptical shape corresponding to the perimeter contour (31) of each of the receiving openings (30) and have a larger lower base (24).

Figure 4:
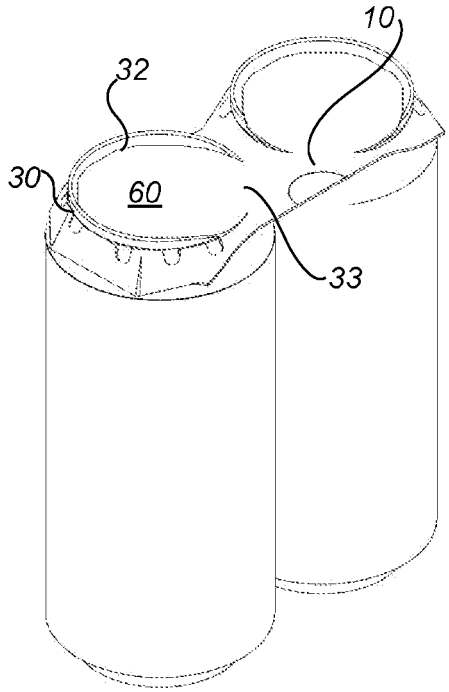
FIG. 4 shows an isometric cutaway view of the carrier device.
Figure 5:
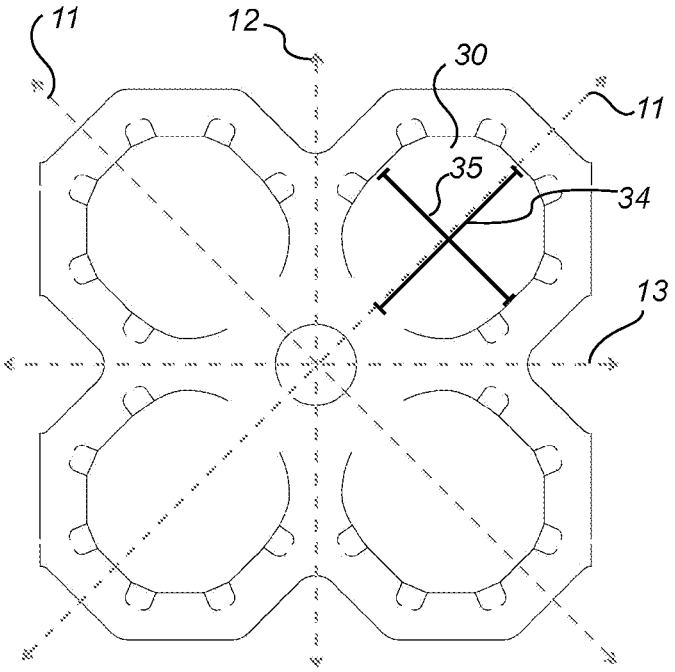
FIG. 5 shows a top floor view of the carrier device.

As illustrated in FIG. 4, the polygonal-elliptical cut line (32) that forms the receiving opening (30) has an interrupted section (33) located adjacent to the upper central area (10) of the device, through which the covering flaps (60) are attached to the device. As properly shown in FIG. 5, the receiving openings (30) have a larger diameter (34) arranged along their length and at least a smaller diameter (35) arranged along their width, where these openings (30) are oriented in the device (1) diagonally with their larger diameter (34) coinciding with an imaginary diagonal axis (11) rotated by 45° with respect to a longitudinal central axis (12) and a transverse central axis (13), and where the openings (30) are distributed equidistant and symmetrical with respect to these axes.

Figure 6:
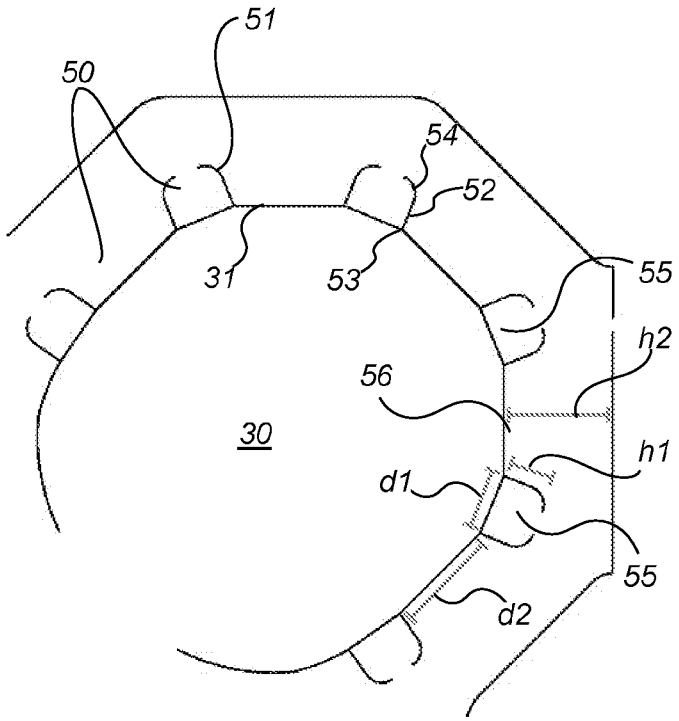
FIG. 6 shows a top floor view of an enlarged detail of the carrier device.

Reference is now made to FIG. 6, where the two types of retainer fins (50) are made up of a plurality of radially symmetrical and spaced pairs of cuts (51), each consisting of a straight distal portion (52) with one end (53) coinciding with the perimeter contour (31) of the opening (30), and a curved opposite end (54) proximally, where the curved ends (54) of both cuts (51) of each pair of cuts are opposite each other; while the two radial cuts (51) are spaced each other by a distance (d1) which is less than a greater distance (d2) between each pair of cuts and because the distance (d1) between the two cuts (51) of each pair forms an auxiliary flange (55); while the greater distance (d2) of separation between the auxiliary flanges (55) form trapezoidal wings (56) intercalated with these auxiliary flanges (55) and where the radial height (h1) of the radial cuts (51) is preferably equivalent to half the width (h2) of the flange (20).

Figure 7:
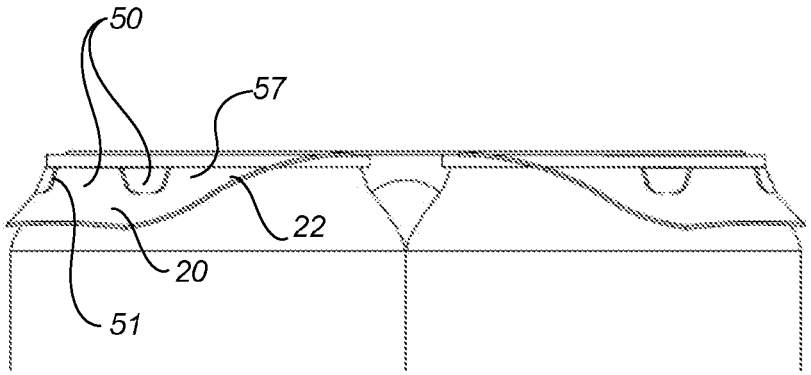
FIG. 7 shows a front cut view of an enlarged detail of the carrier device.

As shown in FIG. 7, the assembly of retaining fins (50) comprises two end fins (57), each located at each proximal ends (22) of the flange (20), where these end fins (57) lack the last radial cut (51) and have a curved shape extending from the bottom of the flange to the upper central area (10) of the device.

Figure 8:
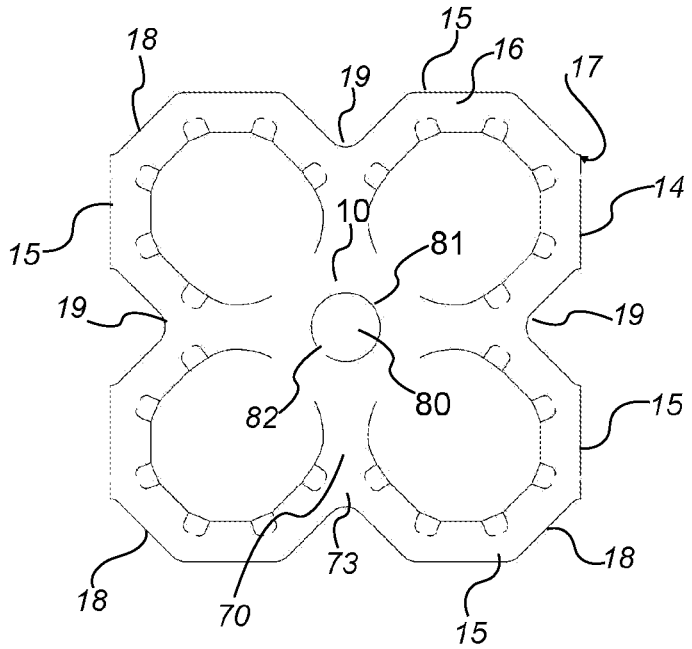
FIG. 8 shows a top floor view of the carrier device.

On the other hand, as better shown in FIG. 8, the carrier device (1) comprises an outer contour (14) preferably formed by four sides (15) parallel in pairs, an upper side (16), a lower side (17) and beveled corners (18) where the four sides (15) of the contour are provided with at least one entering recess (19) arranged between the flanges (20), which coincides with the lower end (73) of the transition portions (70); while the upper substantially horizontal central area (10) comprises a central hinged hole (80) suitable for serving as a handle where the user inserts a finger and lifts the package of cans assembled by the device (1). This hole (80) consists of an incomplete circular cut (81) with one or more connecting bridges (82) which keep it weakly attached to the upper central area (10) of the device.

Figure 9:
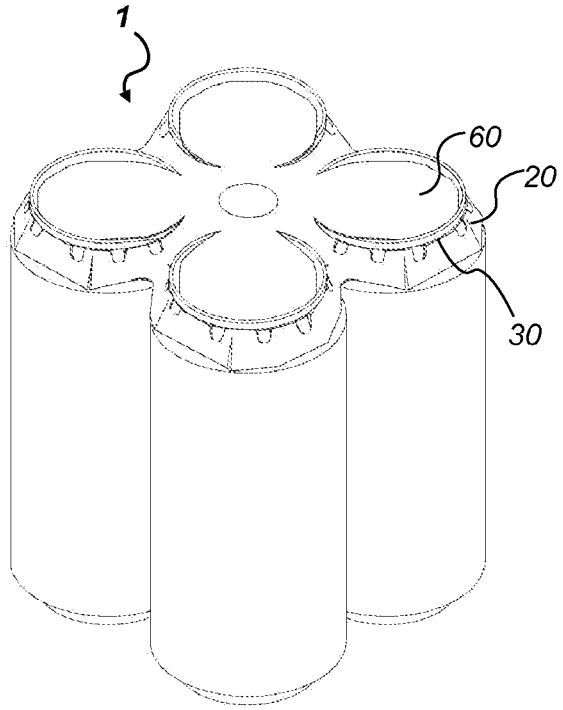
FIG. 9 shows an isometric top view of the carrier device mounted on a group of four beverage cans.

The assembly formed by the clamping flange (20) with the receiving opening (30) and its corresponding covering flap (60) is at least two per device (1); whereas in a preferred embodiment shown in FIG. 9, the assembly formed by the clamping flange (20) with the receiving opening (30) and its corresponding covering flap (60) is at least four per device (1).

The carrier device (1) is made of a single laminar piece of biodegradable cellulosic material, where the cellulosic material is preferably a sheet weighing between 250 and 600 grams per square millimeter.

Figure 10:
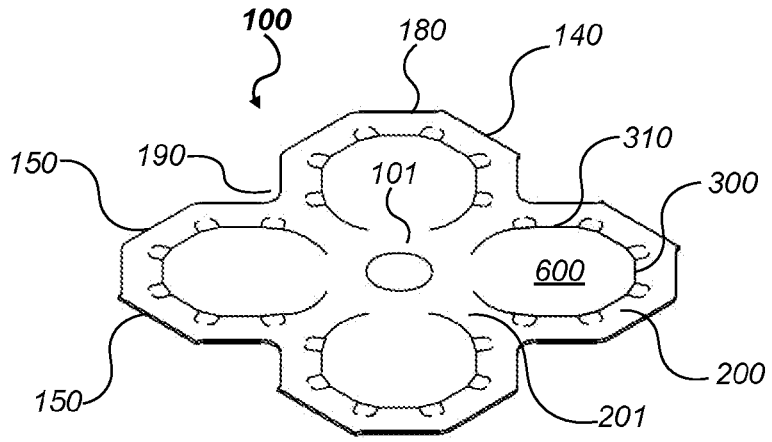
FIG. 10 shows an isometric top view of a template for forming the carrier device.

The disclosure also includes the template (100) to conform to said carrier device (1) for grouping and transporting a set of beverage cans forming a package, where said template (100), as seen in FIG. 10, is made up of a flat plate comprising a contour (140) with four perimeter sides (150) parallel in pairs, each with a recess (190) centered on that side (150) and with beveled edges (180); a central area (101) from which arched portions (200) extend radially, the bases of which (201) pointing towards the central area (101) and each of which surrounding the corresponding receiving openings (300) of polygonal-elliptical shape (310) which are partially covered by a flap (600) also of polygonal-elliptical shape. These recesses (190) are centered on each of the sides (150) of the template and these beveled corners (180) can be smooth edged.

Figure 11:
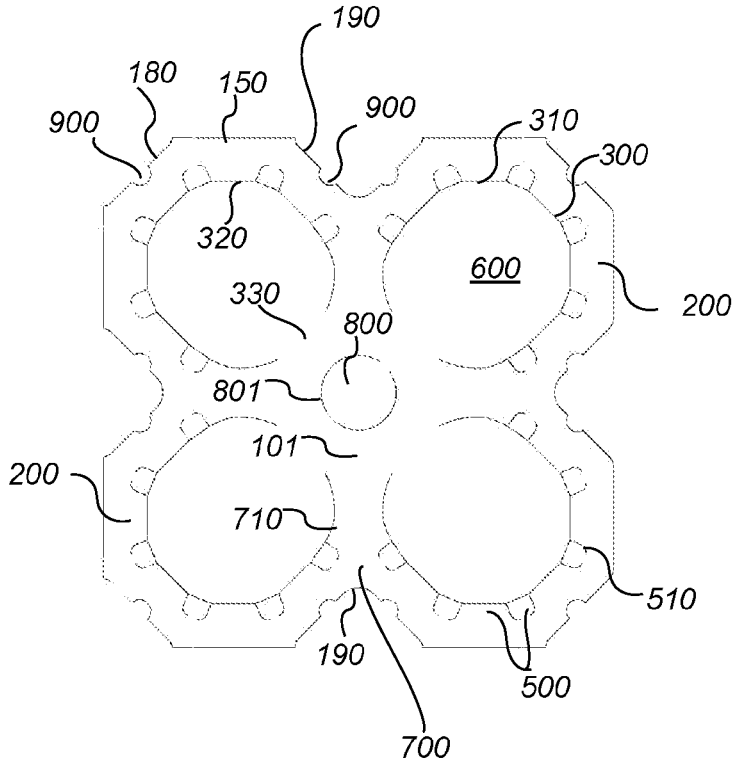
FIG. 11 shows an isometric top view of an alternative mode of a template for forming the carrier device.

As seen in FIG. 11, this contour (310) of the openings (300) comprises a series of radial cuts (510) extending into the arc-shaped portions (200), which are grouped in pairs to form two different types of retainer fins (500); while intercalated between the arched portions (200) there are radial transition areas (700) of concave sides (710) extending from the central area (101) to each of the recesses (190) of the perimeter sides (150) of the template. Similarly, the central area (101) includes an incomplete circular cut (801) that marks a circular piece (800) that can be folded, while the receiving openings (300) and these covering flaps (600) are generated by a cut line (320) with a polygonal-elliptical path that has an interrupted section (330) located adjacent to the central area (101) through which the covering flaps (600) are joined to the template (100). In this alternative embodiment, the recesses (190) which are centered on each of the sides (150) of the template and these beveled corners (180) comprise a notch (900) which facilitates the handling and positioning of the template on an installation machine during its assembly on the cans.

Figure 12:
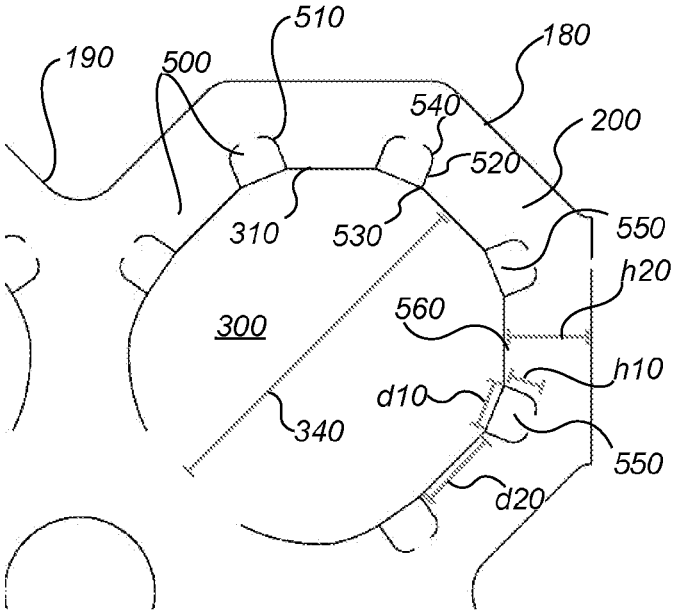
FIG. 12 shows an upper plan view of an enlarged detail of the template for forming the carrier device.

As shown in FIG. 12, the radial cuts (510) forming the retainer fins (500) each consist of a straight distal portion (520) with one end (530) coinciding with the perimeter contour (310) of the opening (300), and an opposite end (540) curved, where these curved ends (540) of both radial cuts (510) of each pair of cuts are facing each other. While the two radial cuts (510) of each pair of cuts are spaced from each other by a smaller distance (d10) to a larger distance (d20) of separation between each of the pairs of cuts and because the distance (d10) between the two cuts (510) of each pair forms an auxiliary clamping flange (550); the distance (d20) between the auxiliary flanges (550) form trapezoidal flaps (560) interspersed with these auxiliary flanges (550) and where the radial height (h10) of the radial cuts (510) is preferably equivalent to half the width (h20) of the arched portions (200). The pairs of radial cuts (510) are distributed over an outer portion of these arched portions (200) which is approximately three-quarters of the length of the largest diameter (340) of these polygonal-elliptical openings (300).

Figure 13:
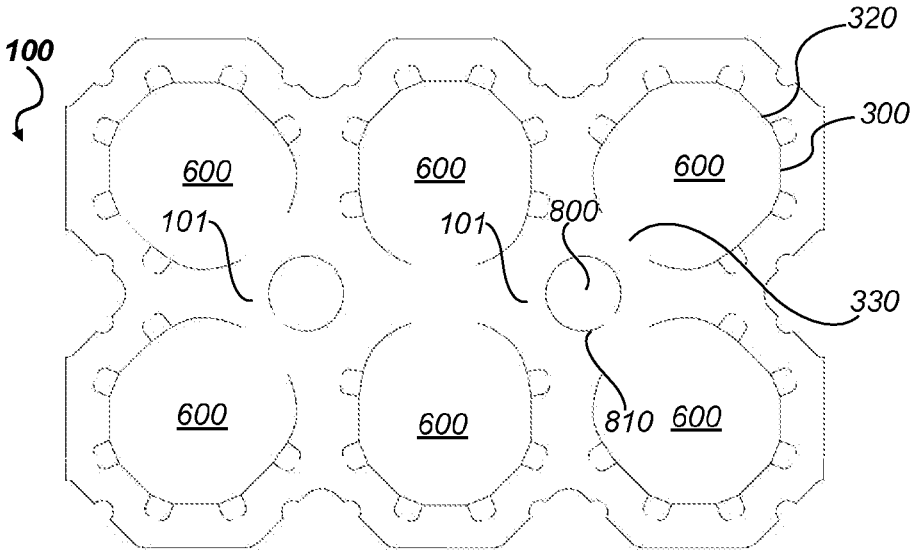
FIG. 13 shows a top floor view of a six-can device.

In an alternative arrangement, the polygonal-elliptical shaped openings (300), their surrounding arched portions (200) and the covering flaps (600) are two per template (100) to carry two cans or may be six, to make a package of six cans, as shown in FIG. 13. In this alternative template for six cans, there are two central areas (101), each comprising an incomplete circular cut (801) demarcating a circular piece (800) that can be folded. Meanwhile, the receiving openings (300) and these covering flaps (600) are also generated by a polygonal-elliptical cut line (320) with an interrupted section (330) located adjacent to the central area (101) through which the covering flaps (600) are joined to the template (100).

The template (100) is made of a single laminated piece of 100% biodegradable and recyclable cellulose material, which is preferably a sheet weighing between 250 and 600 grams per square millimeter.

The templates can be manufactured in arrays of several templates that facilitate the handling of the assembly and its simultaneous installation on a larger number of cans, especially in an automated assembly system; where the templates are joined together by weakened junction points that break when pressure is applied to the template arrangement, causing them to separate and each to be installed on a corresponding group of cans, resulting in an individual pack of two, four, six or more cans.

Figure 14:
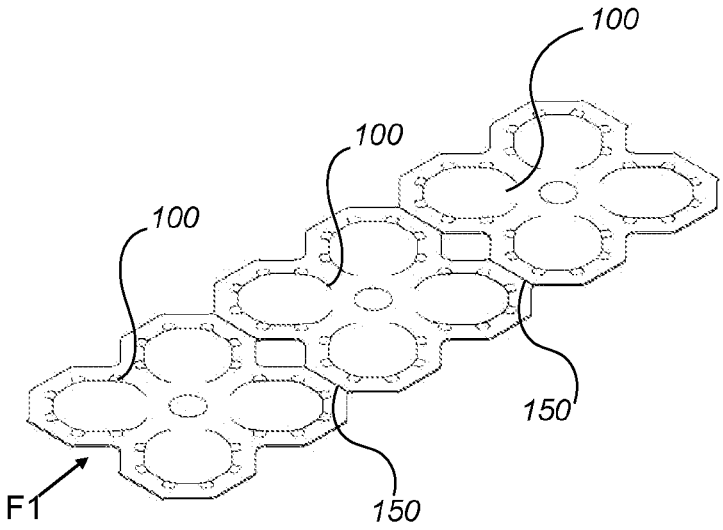
FIG. 14 shows an isometric view of three templates for four cans.
Figure 15:
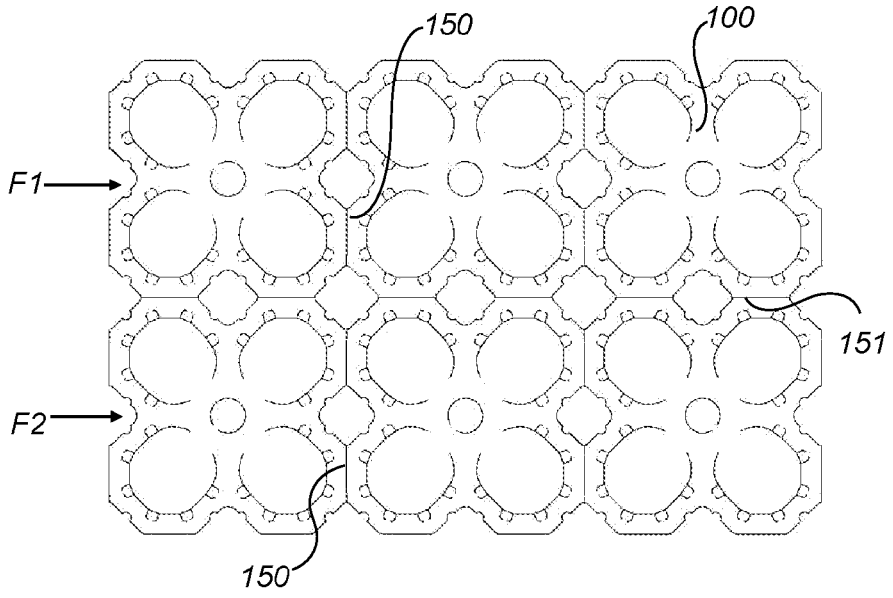
FIG. 15 shows a top floor view of six templates for four cans each.

As shown in FIG. 14, the template (100) for carrying four cans can be arranged in a single-row linear arrangement (F1) comprising at least three templates (100) joined by opposite sides (150) of the template. Meanwhile, as shown in FIG. 15, the same template (100) is arranged in an arrangement comprising six templates (100) arranged in two rows (F1, F2) of three templates (100) each, where the templates in the same row (F1) are joined to each other by opposite sides (150), while the templates (100) in a row (F1) are joined to the attached row (F2) by a common side (151).

Figure 16:
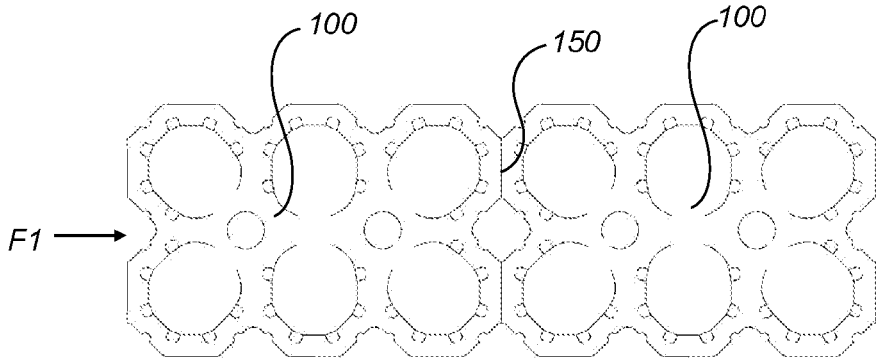
FIG. 16 shows a top floor view of a twelve-can arrangement, with two templates lined up for six cans each.
Figure 17:
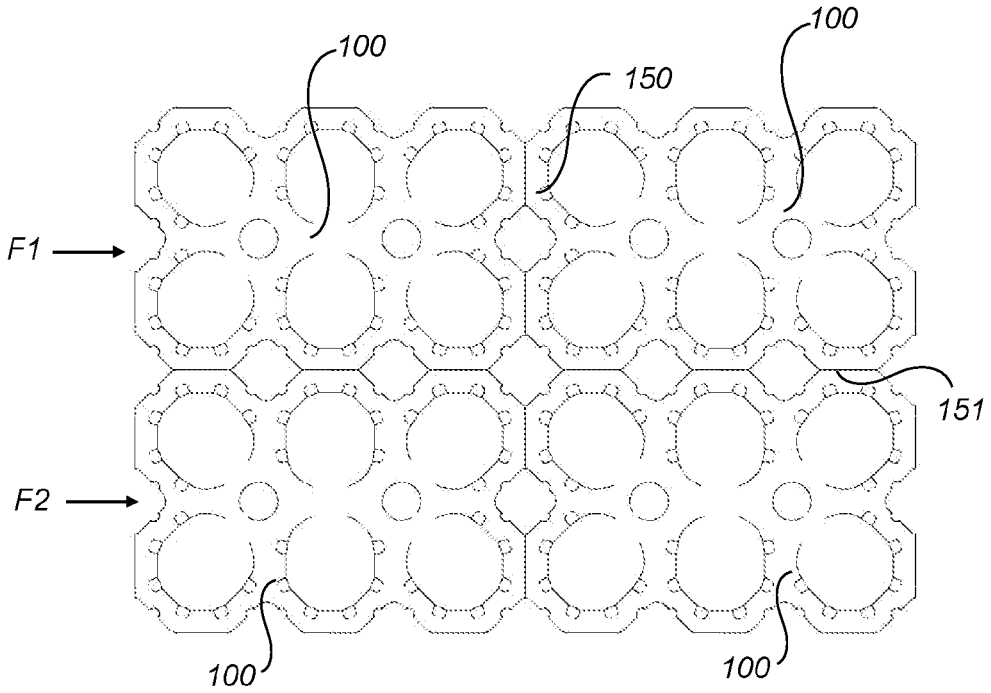
FIG. 17 shows a top floor view of an arrangement for twenty-four cans, with four templates for six cans each.

Similarly, as seen in FIG. 16, the template (100) for carrying six cans can be arranged in a single-row linear arrangement (F1) comprising two templates (100) joined by opposite sides (150) of the template. Meanwhile, as shown in FIG. 17, the same template (100) is arranged in an arrangement comprising six templates (100) arranged in two rows (F1, F2) of two templates (100) each, where the templates in the same row (F1) are joined to each other by opposite sides (150), while the templates (100) in a row (F1) are joined to the attached row (F2) by a common side (151).

The invention claimed is:

1. A carrier device for grouping and transporting a set of cans of beverages forming a package, where the cans are of the type that have a truncated cone upper portion with a raised upper ring that defines an upper plane, said device being manufactured from a single unfolded laminar body, having for each can a receiving opening whose contour has a series of retention fins that fit under the raised upper ring of the can when the device is mounted on the set of cans to form the package, where said device allows a resistant fastening and allows grouping the cans devoid of portions of material that protrude laterally, CHARACTERIZED in that the carrier device comprises:

an upper central area formed in the single unfolded laminar body, said upper central area being arranged at a level above the upper plane of the cans;

perimeter fastening flanges formed in the single unfolded laminar body, said perimeter fastening flanges comprising receiving openings for the cans and having beveled proximal ends through which they join transition portions arranged between the flanges, which extend in a descending inclined radial manner from the upper central area;

wherein the receiving openings have a polygonal-elliptical perimeter contour with radial cuts that form the retention fins, said perimeter contour being formed by an incomplete cut line that generates a covering flap that remains attached and co-planar to the central area of the device; and wherein the fastening flanges adapt to and surround the truncated cone portion of the can, presenting a larger lower base and a smaller upper base, where the smaller upper base gives rise to the perimeter contour of each of the receiving openings.

2. The carrier device according to claim 1, CHARACTERIZED in that the incomplete cutting line comprises an interrupted section located adjacent to the upper central area of the device, through which the covering flaps are attached to the device.

3. The carrier device according to claim 1, CHARACTERIZED in that the receiving openings have a larger diameter arranged along their length and at least one smaller diameter arranged along their width, where these openings are oriented in the device diagonally with their largest diameter matching with an imaginary diagonal axis rotated by 45° with respect to a central longitudinal axis and a transverse central axis.

4. The carrier device according to claim 1, CHARACTERIZED in that some of the receiving openings are oriented in the device diagonally, matching with an imaginary diagonal axis rotated 45° with respect to a longitudinal central axis and a transverse central axis.

5. The carrier device according to claim 1, CHARACTERIZED in that the transition portions have concave curved side edges, an upper end area that is continuous with the upper central area and an opposite lower end with a concave curved edge.

6. The carrier device according to claim 1, CHARACTERIZED in that the set of retention fins is made up of larger fins interspersed with auxiliary fins and where the fins are made up of a plurality of radial cuts arranged in pairs, symmetrical and equidistant from each other; each of the cuts comprising a distal straight portion with an end matching with the perimeter contour of the opening and an opposite curved end, where the curved ends of both cuts of each pair of cuts are facing each other.

7. The carrier device according to claim 6, CHARACTERIZED in that the set of retention fins comprises two end fins, each one located at each of the proximal ends of the flange, where said end fins lack the last radial cut and have a warped shape that extends from the lower part of the flange up to the upper central area of the device.

8. The carrier device according to claim 1, CHARACTERIZED by comprising an outer contour formed by four parallel sides two by two, an upper face, a lower face and beveled vertexes where the four sides of the contour are provided with at least one incoming recess arranged between the flanges.

9. The carrier device according to claim 1, CHARACTERIZED in that said upper central area is substantially horizontal and said upper central area comprises a central hole suitable to serve as a handle where the user inserts a finger and lifts the package of cans collected by the device.

10. The carrier device according to claim 2, CHARACTERIZED in that a set formed by the fastening flange with the receiving opening and its corresponding covering flap are at least two for each device.

11. A template to form a carrier device to group and transport a set of beverage cans forming a package according to claim 1, formed by a flat laminar plate, CHARACTERIZED in that the template comprises a contour with four perimeter parallel sides two by two, each with a recess centered on said side and with beveled vertexes; a central area from which arc-shaped portions extend radially, whose bases point towards said central area and where each of the bases surrounds corresponding receiving openings of polygonal-elliptical contour which are partially covered by a polygonal-elliptical flap, where said contour of the openings comprises a series of radial cuts that extend in the portions that have the shape of an arc, which are grouped in pairs that make up two different types of retention fins; while interspersed between the arches there are radial transition areas with concave flanks that extend from said central area towards each of the recesses on the perimeter sides of the template.

12. The template to form a carrier device according to claim 11, CHARACTERIZED in that the central area comprises an incomplete circular cut that demarcates a folding circular piece.

13. The template to form a carrier device according to claim 11, CHARACTERIZED in that said receiving openings and said covering flaps are generated by a cutting line with a polygonal-elliptical path that has an interrupted section located adjacent to the central area through which the covering flaps are attached to the template.

14. The template to form a carrier device according to claim 11, CHARACTERIZED in that the radial cuts that form the retention fins are each formed by a distal straight portion with an end matching with the perimeter contour of the opening, and an opposite end with a curved end, where said curved ends of both radial cuts of each pair of cuts are facing each other.

15. The template to form a carrier device according to claim 11, CHARACTERIZED in that the pair of radial cuts are distributed in an inner portion of said portions in the form of an arc that is equivalent to at least three quarters of the perimeter of said polygonal-elliptical openings.

16. The template to form a carrier device according to claim 11, CHARACTERIZED in that said recesses centered on each of the sides of the template and said beveled vertexes have a smooth edge.

17. The template to form a carrier device according to claim 11, CHARACTERIZED in that said recesses centered on each of the sides of the template and said beveled vertexes comprise a notch that facilitates the handling of the template during its assembly on the beverage cans.

18. The template to form a carrier device according to claim 11, CHARACTERIZED in that the set formed by the openings of polygonal-elliptical contour, their arc-shaped portions that surround them and the covering flaps are at least two per each template.

* * * * *